US009977386B2

(12) United States Patent
Sato

(10) Patent No.: US 9,977,386 B2
(45) Date of Patent: May 22, 2018

(54) IMAGE FORMING APPARATUS AND METHOD FOR DETERMINING IMAGE FORMING CONDITION BASED ON CHARACTERISTIC OF SHEET TO FORM IMAGES

(71) Applicant: CANON KABUSHIKI KAISHA, Tokyo (JP)

(72) Inventor: Mitsuhiko Sato, Kashiwa-shi (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days. days.

(21) Appl. No.: 15/420,591

(22) Filed: Jan. 31, 2017

(65) Prior Publication Data

US 2017/0219980 A1 Aug. 3, 2017

(30) Foreign Application Priority Data

Feb. 2, 2016 (JP) ..... 2016-018279

(51) Int. Cl.
*G03G 15/00* (2006.01)
*G03G 15/20* (2006.01)

(52) U.S. Cl.
CPC ..... *G03G 15/5062* (2013.01); *G03G 15/50* (2013.01); *G03G 15/2046* (2013.01); *G03G 2215/00738* (2013.01); *G03G 2215/0129* (2013.01)

(58) Field of Classification Search
CPC ..... G03G 15/50; G03G 15/2039; G03G 15/2078; G03G 15/5029
USPC ..... 399/45, 68, 69, 82
See application file for complete search history.

(56) References Cited

U.S. PATENT DOCUMENTS 5,905,925 A * 5/1999 Kawabata et al. . G03G 15/5029 399/45
8,369,723 B2 * 2/2013 Hosoda ..... G03G 15/2039 399/45
8,412,062 B2 * 4/2013 Kielland ..... B41J 29/393 399/45
2011/0001996 A1 1/2011 Yokoyama

* cited by examiner

*Primary Examiner* — William J Royer
(74) *Attorney, Agent, or Firm* — Canon U.S.A., Inc. IP Division

(57) ABSTRACT

An image forming apparatus determines, in a first mode, an image forming condition according to characteristic data, which is input by a user and represents characteristics of a sheet contained in a sheet container, causes a sensor to detect characteristics of a sheet, and stores characteristic data according to a result of the detection into a memory. The image forming apparatus determines, in a second mode with the characteristic data being stored in the memory, an image forming condition, based on the characteristic data stored in the memory before a result of detecting a characteristic of a sheet by the sensor is obtained. The image forming apparatus causes, in the second mode with the characteristic data being not stored in the memory, the sensor to detect characteristics of a sheet, and determines an image forming condition based on a result of the detection.

9 Claims, 10 Drawing Sheets

IN THE CASE OF THIN PAPER

IN THE CASE OF THICK PAPER

IMAGE FORMING APPARATUS AND METHOD FOR DETERMINING IMAGE FORMING CONDITION BASED ON CHARACTERISTIC OF SHEET TO FORM IMAGES

BACKGROUND OF THE INVENTION

Field of the Invention

One disclosed aspect of the embodiments relates to an image forming apparatus, such as a printer, a copying machine, or a multifunction peripheral, that forms an image on a sheet.

Description of the Related Art

An image forming apparatus forms an electrostatic latent image by irradiating a photosensitive member with a laser beam, and forms a toner image by developing this electrostatic latent image with toner. The image forming apparatus then transfers the formed toner image onto a sheet, and fixes the toner image with heat. The image forming apparatus thus forms an image on a sheet. The image forming apparatus sets an image forming condition, e.g., an optimum fixing temperature and a sheet conveyance speed, according to sheet characteristics. Examples of the sheet characteristics include a sheet thickness, a sheet surface condition, and a sheet type. The sheet characteristics are set by a user operation via an operation unit provided on the image forming apparatus and/or a print setting screen of a printer driver. Some commercialized image forming apparatuses detect sheet characteristics with a built-in sensor (hereinafter referred to as "medium sensor"), and automatically set an image forming condition according to the detection result. Using the medium sensor eliminates need for setting the sheet characteristics by the user, thereby enhancing usability.

In such an image forming apparatus, either "automatic detection mode" or "user specification mode" is selectable as an operation mode. The automatic detection mode is provided to detect the sheet characteristics by using the medium sensor. The user specification mode is provided to set the sheet characteristics through the user operation. Detection of sheet characteristics by using the medium sensor is difficult depending on types of sheet characteristics. To that end, the image forming apparatus has the user specification mode for manually setting the sheet characteristics without using the medium sensor. The user designates the operation mode.

The medium sensor is generally provided on a sheet conveyance path between a sheet feed cassette and a transfer position. The medium sensor detects the sheet characteristics when the conveyed sheet arrives at a position where the medium sensor is provided. The image forming apparatus adjusts each part in the image forming apparatus, in order to form an image under an image forming condition according to the sheet characteristics detected by the medium sensor. Meanwhile, the conveyance of the sheet is in a waiting state. To suppress the occurrence of such a waiting state, United States Patent Publication Application No. 2011/0001996 discusses an image forming apparatus that forms an image by using sheet characteristics detected from a first sheet, without detecting sheet characteristics of second and subsequent sheets, among sheets fed from the same sheet feed cassette. This image forming apparatus needs not to detect the sheet characteristics of the second and subsequent sheets, and thus can suppress the occurrence of the waiting state, which reduces image forming time period.

Setting of the user specification mode causes the image forming apparatus not to detect the sheet characteristics with the medium sensor, even in a case where the sheets are fed from the same sheet feed cassette. As a result, in a case where the operation mode is changed from the user specification mode to the automatic detection mode, the sheet characteristic detection is performed, and conveyance of sheets becomes in a waiting state, causing the occurrence of waiting time. This increases the time necessary for an image forming process.

One disclosed embodiment is directed to an image forming apparatus that suppresses additional image forming time due to detection of sheet characteristics, even in a case where an operation mode is switched.

SUMMARY OF THE INVENTION

According to an aspect of the embodiments, an image forming apparatus includes a sheet container, an image forming unit, a sensor, a memory, a selector, and a controller. The sheet container is configured to contain a sheet. The image forming unit is configured to form an image on the sheet fed from the sheet container. The sensor is configured to detect a characteristic of the sheet fed from the sheet container. The memory is configured to store characteristic data representing the characteristic detected by the sensor. The selector is configured to select either a first mode or a second mode. The controller is configured to determine, in a case where the first mode is selected by the selector, an image forming condition according to the characteristic data, which is input by a user and represents a characteristic of a sheet contained in the sheet container and cause the sensor to detect a characteristic of a sheet, and store characteristic data according to a result of the detection into the memory. The controller is also configured to determine, in a case where the second mode is selected by the selector with the characteristic data being stored in the memory, an image forming condition based on the characteristic data stored in the memory before a result of detecting a characteristic of a sheet by the sensor is obtained, and configured to cause, in a case where the second mode is selected by the selector with the characteristic data not being stored in the memory, the sensor to detect a characteristic of a sheet, and determine an image forming condition based on a result of the detection by the sensor.

Further features of the disclosure will become apparent from the following description of exemplary embodiments with reference to the attached drawings.

DESCRIPTION OF THE EMBODIMENTS

An exemplary embodiment will be described in detail below with reference to the drawings.

(Configuration)

Figure 1:
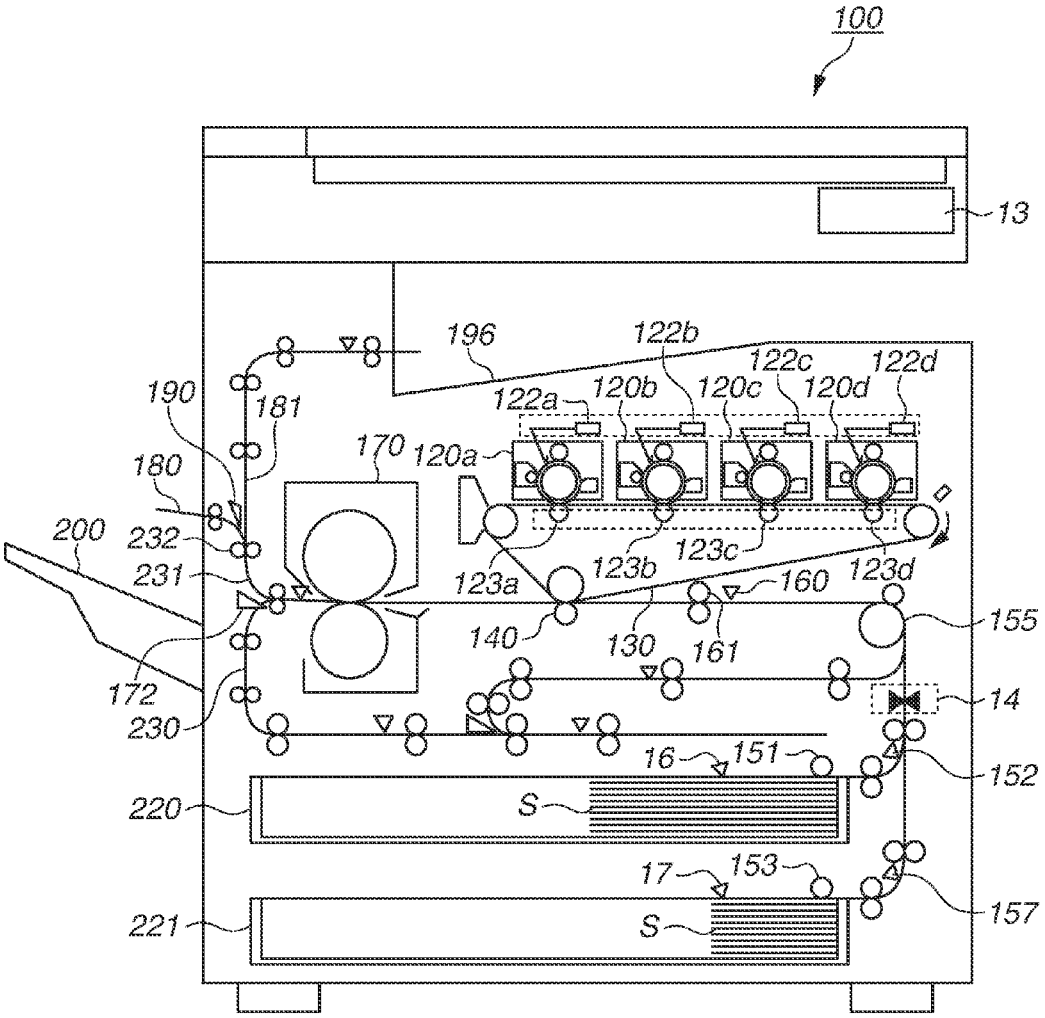
FIG. 1 is a diagram illustrating a configuration of an image forming apparatus.

FIG. 1 is a diagram illustrating a configuration of an image forming apparatus according to the present exemplary embodiment. An image forming apparatus 100 includes image forming units 120*a* to 120*d*, laser scanners 122*a* to 122*d*, primary transfer units 123*a* to 123*d*, an intermediate transfer belt 130, a secondary transfer unit 140, a fixing unit 170, a first sheet feed cassette 220, a second sheet feed cassette 221, and an operation unit 13.

The image forming units 120*a* to 120*d* each include a charger, a photosensitive member, and a developing unit. A surface of each of the photosensitive members is charged by the charger, and then irradiated with a laser beam by the corresponding one of the laser scanners 122*a* to 122*d* to form an electrostatic latent image. The developing unit forms a toner image on the photosensitive member by developing the electrostatic latent image with toner. A toner image of yellow is formed on the photosensitive member of the image forming unit 120*a*. A toner image of magenta is formed on the photosensitive member of the image forming unit 120*b*. A toner image of cyan is formed on the photosensitive member of the image forming unit 120*c*. A toner image of black is formed on the photosensitive member of the image forming unit 120*d*.

The primary transfer units 123*a* to 123*d* each transfer the toner image formed on the photosensitive member of the corresponding one of the image forming units 120*a* to 120*d*, to the intermediate transfer belt 130 so that the transferred toner images are superimposed. The intermediate transfer belt 130 rotates clockwise in FIG. 1, and the toner images are transferred in order of yellow, magenta, cyan, and black. The intermediate transfer belt 130 rotates to convey the transferred toner images to the secondary transfer unit 140.

The first and second sheet feed cassettes 220 and 221 each contain sheets S on which images are to be formed. The first and second sheet feed cassettes 220 and 221 may contain the sheets S of the same type, or may contain the sheets S of different types in terms of material, thickness, or size. The sheets S are fed from the first and second sheet feed cassettes 220 and 221, and conveyed to the secondary transfer unit 140. On a conveyance path from the first and second sheet feed cassettes 220 and 221 to the secondary transfer unit 140, provided are pickup rollers 151 and 153, pickup sensors 152 and 157, a medium sensor 14, a conveyance roller 155, a conveyance sensor 160, and a registration roller 161.

The sheets S contained in the first sheet feed cassette 220 are fed one by one by the pickup roller 151. The fed sheets S are monitored as to whether the sheets S are fed one by one by the pickup sensor 152. The sheet S contained in the second sheet feed cassette 221 are fed one by one by the pickup roller 153. The fed sheets S are monitored as to whether the sheets S are fed one by one by the pickup sensor 157.

The medium sensor 14 is used to detect a sheet characteristic(s) such as the thickness, the surface state, and the type of the sheet S. The medium sensor 14 will be described in detail below. The conveyance roller 155 conveys the sheet S from the medium sensor 14 to the registration roller 161. In a case where the conveyance sensor 160 detects the conveyed sheet S, the registration roller 161 temporarily stops before the leading edge of the sheet S arrives at the registration roller 161. The registration roller 161 conveys the sheet S to the secondary transfer unit 140 in time with the conveyance of the toner images to the secondary transfer unit 140 by the intermediate transfer belt 130.

The secondary transfer unit 140 transfers the toner image formed on the intermediate transfer belt 130, onto the sheet S conveyed by the registration roller 161. The fixing unit 170 fixes the transferred toner image to the sheet S by heat. The fixing unit 170 fixes the toner image by heat according to an image forming condition. Examples of the image forming condition include a fixing temperature corresponding to the sheet characteristic(s) of the sheet S, and a conveyance speed for conveying the sheet S. In one-sided printing or printing on a second side in double-sided printing, the sheet S with the toner images fixed thereon by the fixing unit 170 is conveyed to a sheet discharge conveyance path 231. In a case where printing on a first side is performed in the double-sided printing, the sheet S with the toner images fixed thereon is conveyed to a two-sided conveyance path 230. A conveyance flapper 172 sends the sheet S to either the two-sided conveyance path 230 or the sheet discharge conveyance path 231. The faces of the sheet S conveyed to the two-sided conveyance path 230 are turned over, and then the sheet S is conveyed from the conveyance roller 155 to the registration roller 161. This sheet S is then conveyed from the registration roller 161 to the secondary transfer unit 140 to be subjected to transfer of the toner images again.

The image forming apparatus 100 includes a sheet discharge tray 196 and a sheet discharge tray 200 to which the sheet S is to be discharged. The sheet S conveyed to the sheet discharge conveyance path 231 is conveyed to either a face up conveyance path 180 or a face down conveyance path 181 by a conveyance roller 232. A conveyance flapper 190 sends the sheet S to either the face up conveyance path 180 or the face down conveyance path 181. The sheet S sent to the face up conveyance path 180 is discharged to the sheet discharge tray 200. The sheet S sent to the face down conveyance path 181 is discharged to the sheet discharge tray 196.

The operation unit 13 is an input/output device including components such as key buttons and a touch panel including a display and a touchpad. A user can input various kinds of information (the number of sheets, image quality, and one-side/double-sided printing) about an image forming process, by using the operation unit 13. The user can also input the thickness and the surface state of the sheet S, the sheet characteristic(s) such as the material of the sheet S, and an instruction to start the image forming process, using the operation unit 13.

In the image forming apparatus 100, either an "automatic detection mode" or a "user specification mode" is selectable as an operation mode. In the automatic detection mode, the sheet characteristic(s) is (are) detected with the medium sensor 14. In the user specification mode, the sheet characteristic(s) is (are) set by the user operation. The user can specify in which mode the image forming apparatus 100 is to be operated via the operation unit 13.

Figure 2:
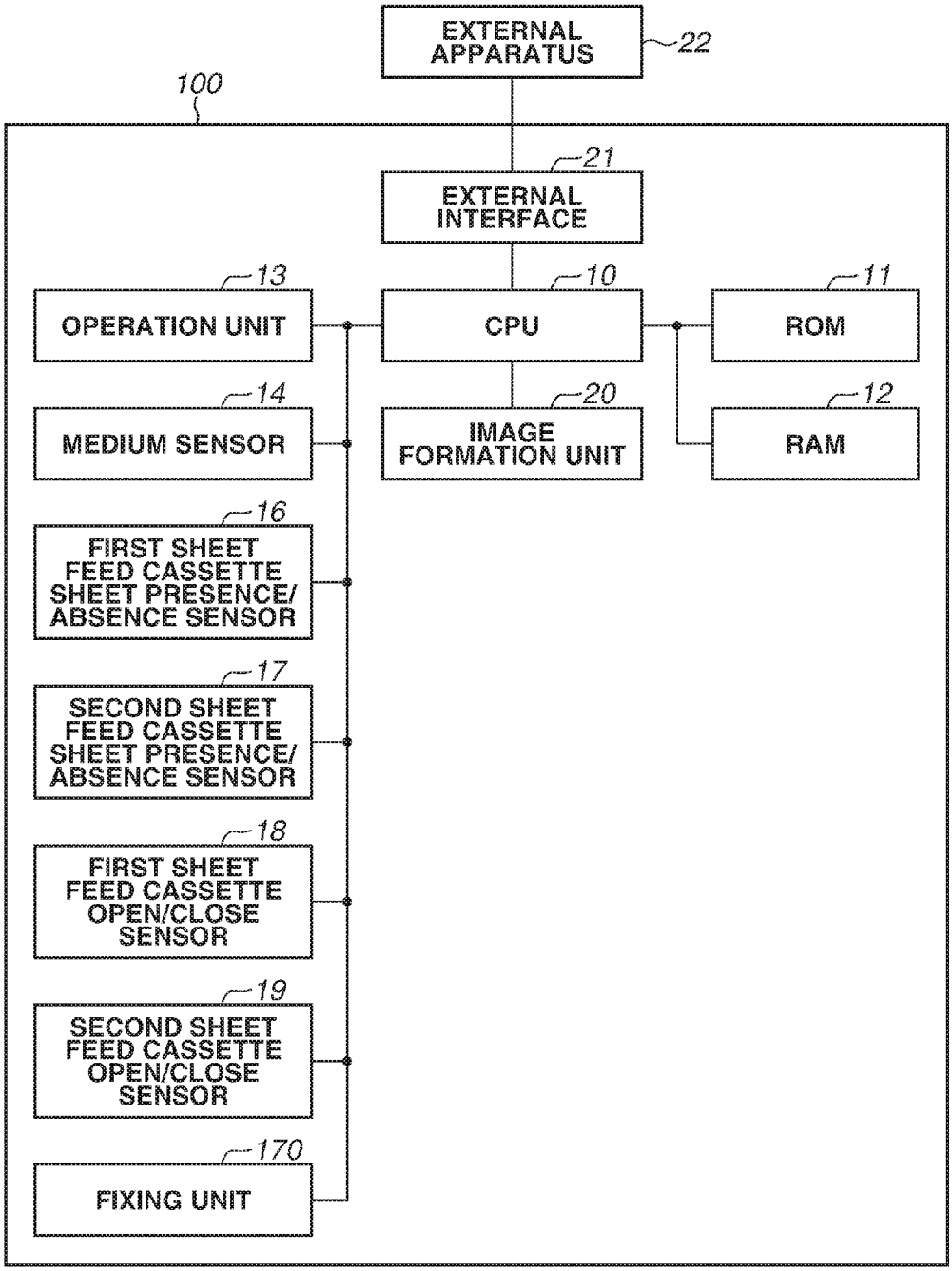
FIG. 2 is a diagram illustrating a configuration of a control unit.

FIG. 2 is a diagram illustrating a configuration of a control unit for controlling operation of the image forming apparatus 100. The control unit includes a central processing unit (CPU) 10, a read only memory (ROM) 11, a random access memory (RAM) 12, an image formation unit 20, and an external interface (I/F) 21.

The CPU 10 is connected to the operation unit 13, the medium sensor 14, and the fixing unit 170, in addition to first and second sheet feed cassette sheet presence/absence sensors 16 and 17, first and second sheet feed cassette open/close sensors 18 and 19. The CPU 10 may be a specialized processor or a general-purpose processor that may execute a computer program. The CPU 10 controls the operation of the image forming apparatus 100 by reading a computer program from the ROM 11, and executing the read computer program by using the RAM 12 as a working area. For example, the CPU 10 performs the image forming process by controlling operation of each of the image formation unit 20 and the fixing unit 170 based on detection results from various sensors, various kinds of information and instructions input by the user through the operation unit 13, and various kinds of information and instructions from an external apparatus 22 (described below). The computer program in the memory, either the ROM 11 or the RAM 12, includes instructions that, when executed by the CPU 10, cause the CPU 10 to perform operations described above and/or operations described in FIGS. 8 and 9.

The image formation unit 20 controls operations of the image forming units 120*a* to 120*d*, the laser scanners 122*a* to 122*d*, the intermediate transfer belt 130, the primary transfer units 123*a* to 123*d*, the secondary transfer unit 140, and various rollers for conveying the sheet S, under the control of the CPU 10. The image formation unit 20 controls operation for forming the toner images to the sheet S.

The first sheet feed cassette sheet presence/absence sensor 16 detects presence or absence of the sheet S in the first sheet feed cassette 220. The first sheet feed cassette open/close sensor 18 detects whether the first sheet feed cassette 220 is attached to a main body of the image forming apparatus 100. The first sheet feed cassette 220 is attachable to and drawable from the main body of the image forming apparatus 100. The first sheet feed cassette open/close sensor 18 is provided at a part, of the main body of the image forming apparatus 100, to which the first sheet feed cassette 220 is to be attached. The first sheet feed cassette open/close sensor 18 detects attachment and drawing of the first sheet feed cassette 220, i.e., opening and closing of the first sheet feed cassette 220.

The second sheet feed cassette sheet presence/absence sensor 17 detects presence or absence of the sheet S in the second sheet feed cassette 221. The second sheet feed cassette open/close sensor 19 detects whether the second sheet feed cassette 221 is attached to the main body of the image forming apparatus 100. The second sheet feed cassette 221 is attachable to and drawable from the main body of the image forming apparatus 100. The second sheet feed cassette open/close sensor 19 is provided at a part, of the main body of the image forming apparatus 100, to which the second sheet feed cassette 221 is to be attached. The second sheet feed cassette open/close sensor 19 detects attachment and drawing of the second sheet feed cassette 221, i.e., opening and closing of the second sheet feed cassette 221.

In the present exemplary embodiment, a description is given taking as an example a case where two sheet feed cassettes are provided. Alternatively, only one sheet feed cassette may be provided, or more sheet feed cassettes may be provided. In the case of providing a plurality of sheet feed cassettes, a sheet feed cassette sheet presence/absence sensor and a sheet feed cassette open/close sensor are provided for each of the sheet feed cassettes.

The external interface 21 is an interface for controlling communication with the external apparatus 22 such as a personal computer, via a local area network (LAN) or a serial bus. The external apparatus 22 inputs various kinds of information (including the number of sheets, image quality, one-side/double-sided printing) about the image forming process, to the CPU 10 via the external interface 21. The external apparatus 22 also inputs the thickness and the surface state of the sheet S, the sheet characteristic(s) such as the type of the sheet S, and an instruction to start the image forming process, to the CPU 10 via the external interface 21.

(Image Forming Process)

The image forming apparatus 100 as described above starts the image forming process with the CPU 10 in response to receiving conditions (such as characteristic(s) of a sheet to be used) for image formation and an instruction to start the image forming process from the operation unit 13 or the external apparatus 22. The CPU 10 causes the image formation unit 20 to start the image formation in response to receiving the instruction to start the image forming process.

The image formation unit 20 feeds the sheets S one by one from the first sheet feed cassette 220 by driving the pickup roller 151 or from the second sheet feed cassette 221 by driving the pickup roller 153 under the control of the CPU 10. The pickup sensors 152 and 157 each detect whether the sheets S are fed one by one, and transmit a result of the detection to the CPU 10. The conditions of the image formation, received together with the start instruction, indicate the sheet S is to be fed from the first sheet feed cassette 220 or the second sheet feed cassette 221.

The medium sensor 14 detects the characteristic(s) of the fed sheet S during the conveyance. In a case where the medium sensor 14 detects the sheet S, the conveyance of the sheet S temporarily stops or a conveyance speed decreases. The medium sensor 14 can thus detect the characteristics of the sheet S more accurately. The medium sensor 14 then transmits a result of the detection to the CPU 10.

In a case where the automatic detection mode is set, the CPU 10 determines an image forming condition, according to the sheet characteristic(s) determined based on the detection result obtained from the medium sensor 14. Examples of the image forming condition include the fixing temperature of the fixing unit 170 and the conveyance speed of the sheet S during the fixing. The CPU 10 determines a quantity of heat for fixing a toner image to the sheet S according to the sheet characteristics, and determines the image forming condition to achieve the determined quantity of heat. The image forming condition is, for example, the fixing temperature of the fixing unit 170, the conveyance speed of the sheet S during conveyance in the fixing unit 170, or the combination of these. For example, the conveyance speed for thick paper during the fixing is set to half of the conveyance speed for plain paper or thin paper. This configuration provides a regular temperature for fixing the toner image to the sheet S is constant regardless of the type of the sheet S. The present exemplary embodiment is described assuming that the fixing temperature is determined according to the sheet characteristic(s), and the conveyance speed during the fixing is constant. In a case where the user specification mode is set, the CPU 10 determines the image forming condition according to the sheet characteristic(s) received from the operation unit 13 or the external apparatus 22, as in the automatic detection mode.

The image formation unit 20 conveys the sheet S having passed through the medium sensor 14 to the registration roller 161 using the conveyance roller 155. In a case where the conveyance sensor 160 detects the sheet S, the CPU 10 causes the image formation unit 20 to stop driving the registration roller 161 in response to this detection, thereby stopping the conveyance of the sheet S.

The image formation unit 20 causes the image forming units 120*a* to 120*d* to form the toner images. The primary transfer units 123*a* to 123*d* then transfer the toner images to the intermediate transfer belt 130. The image formation unit 20 drives the registration roller 161 in time with the toner image, formed on the intermediate transfer belt 130, being conveyed to the secondary transfer unit 140, to convey the sheet S to the secondary transfer unit 140. With this configuration, the leading edge of the sheet S meets the leading edge of the toner image formed on the intermediate transfer belt 130 at the secondary transfer unit 140. The toner image is thus transferred from the intermediate transfer belt 130 to the sheet S at the secondary transfer unit 140. The secondary transfer unit 140 conveys the sheet S to the fixing unit 170, after the transfer of the toner image.

The CPU 10 performs controls so that the fixing temperature of the fixing unit 170 becomes a temperature optimum for the sheet S, based on the image forming condition. The fixing unit 170 fixes the transferred toner image on the sheet S by heat. The sheet S to which the toner image is fixed is discharged to the sheet discharge tray 200 or the sheet discharge tray 196 as described above, and a series of steps in the image forming process ends.

(Sheet Characteristic Detection)

Figure 3:
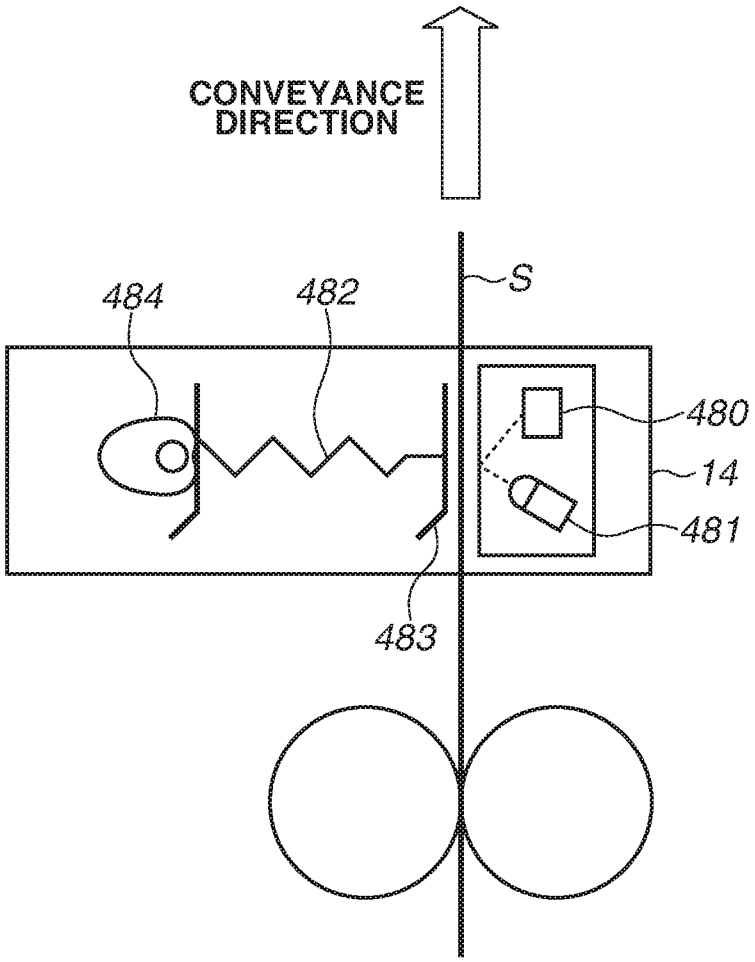
FIG. 3 is a diagram illustrating an example of a configuration of a medium sensor.

FIG. 3 is a diagram illustrating an example of a configuration of the medium sensor 14 used for the detection of the sheet characteristic(s). The medium sensor 14 includes a light emitting unit 481, a light receiving unit 480, a guide portion 483, a spring 482, and a cam 484.

The light emitting unit 481 includes a light emitting element such as a light emitting diode (LED). The light emitting unit 481 emits light to the sheet S passing through the medium sensor 14. The light receiving unit 480 includes a light receiving element such as a photodiode, and receives reflection light, reflected by the sheet S, from the light emitting unit 481. The light receiving unit 480 transmits a detection result corresponding to the amount of the received reflection light (hereinafter referred to as the "amount of reflection light"), to the CPU 10. The CPU 10 recognizes the sheet characteristic(s) of the sheet S according to the detection result.

The guide portion 483 presses the sheet S toward the light emitting unit 481 and the light receiving unit 480 with the spring 482. The pressing force of the spring 482 is changed with the cam 484 rotated by a drive unit (not illustrated). The pressing force increases in a case where the cam 484 rotates in a direction in which an execution length of the spring 482 decreases. The pressing force decreases when the cam 484 rotates in a direction in which the execution length of the spring 482 increases. During the detection of the sheet S, the cam 484 rotates to change the pressing force of the spring 482.

FIGS. 4A, 4B, 4C, and 4D are diagrams each illustrating a conveyance state of the sheet S when the sheet characteristic(s) of the sheet S is (are) detected using the medium sensor 14.

Figure 4A:
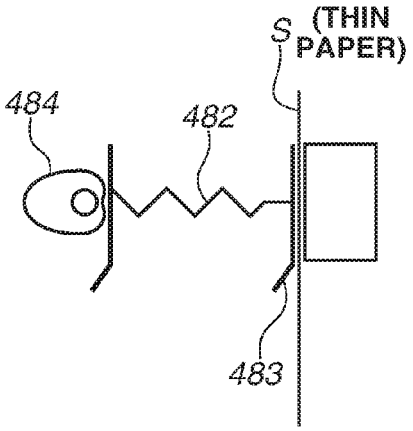
FIGS. 4A, 4B, 4C, and 4D are diagrams each illustrating a sheet conveyance state.
Figure 4B:
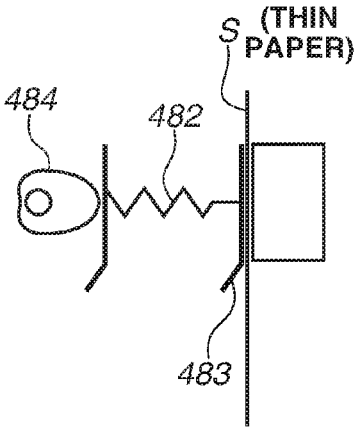

FIG. 4A illustrates a conveyance state where the sheet S is a thin paper and the pressing force of the spring 482 is weak (the cam 484 is at a first position). FIG. 4B illustrates a conveyance state where the sheet S is a thin paper and the pressing force of the spring 482 is strong (the cam 484 is at a second position). The sheet S of the thin paper is conveyed in a stable state along the guide portion 483, regardless of pressing force level of the spring 482.

Figure 4C:
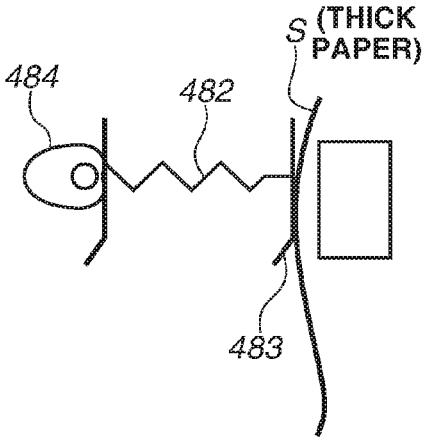
Figure 4D:
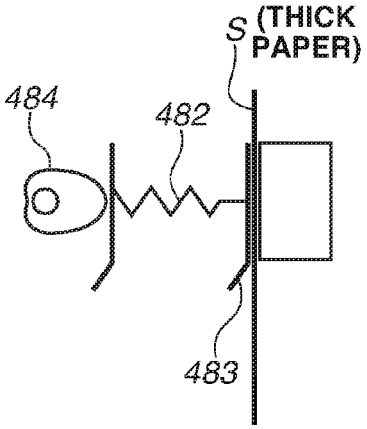

FIG. 4C illustrates a conveyance state where the sheet S is a thick paper and the pressing force of the spring 482 is weak. FIG. 4D illustrates a conveyance state where the sheet S is a thick paper and the pressing force of the spring 482 is strong. The sheet S of a thick paper is resistant to deformation, and thus the sheet S is conveyed while pushing up the guide portion 483 in a case where the pressing force is weak. The sheet S is conveyed in a stable state along the guide portion 483 in a case where the pressing force is strong.

Figure 5A:
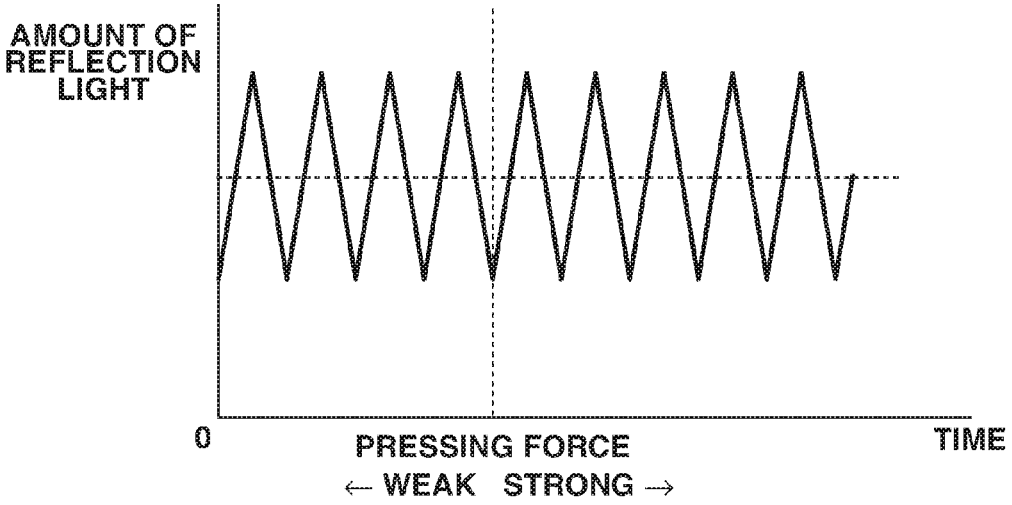
FIGS. 5A and 5B are diagrams each illustrating an example of an amount of reflection light.
Figure 5B:
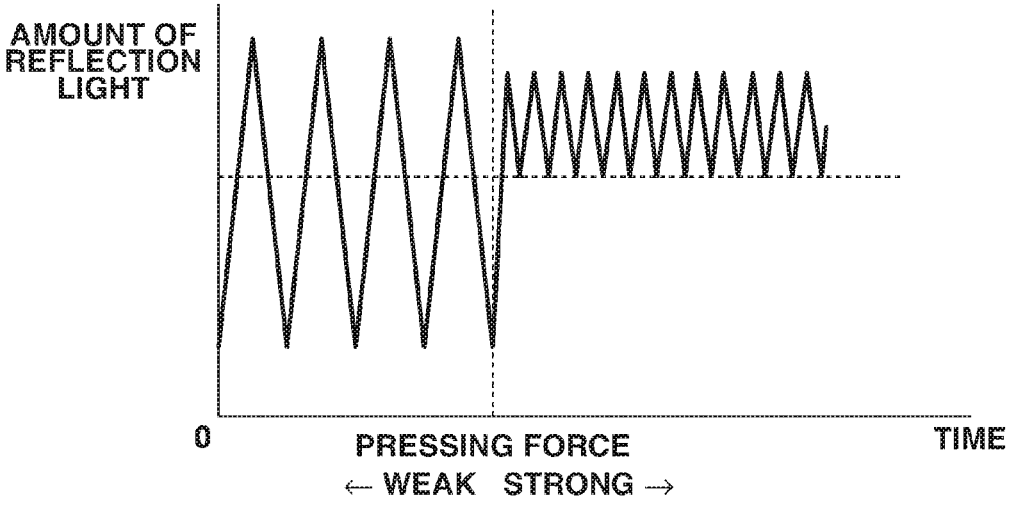

In this way, the stability of the conveyance state changes depending on whether the sheet characteristic of the sheet S is a thick paper or a thin paper. The amount of reflection light received by the light receiving unit 480 varies according to the stability of the conveyance state. FIGS. 5A and 5B are diagrams each illustrating the amount of reflection light.

FIG. 5A illustrates the amount of reflection light in a case where the sheet S is a thin paper. In a case of the sheet S of the thin paper, the conveyance state is stable regardless of the pressing force of the spring 482, so that the average value amount and the degree of unevenness of the reflection light become stable.

FIG. 5B illustrates the amount of reflection light in a case where the sheet S is the thick paper. In the case of the sheet S of the thick paper, the average value of the amount of reflection light is high and the unevenness is small with strong pressing force of the spring 482. With weak pressing force of the spring 482, the average value of the amount of reflection light is lower and the unevenness is greater than those with the strong pressing force. In the case of the sheet S of the thick paper, the conveyance state becomes unstable with weak pressing force of the spring 482, so that the above-described difference in the amount of reflection light occurs.

Figure 6:
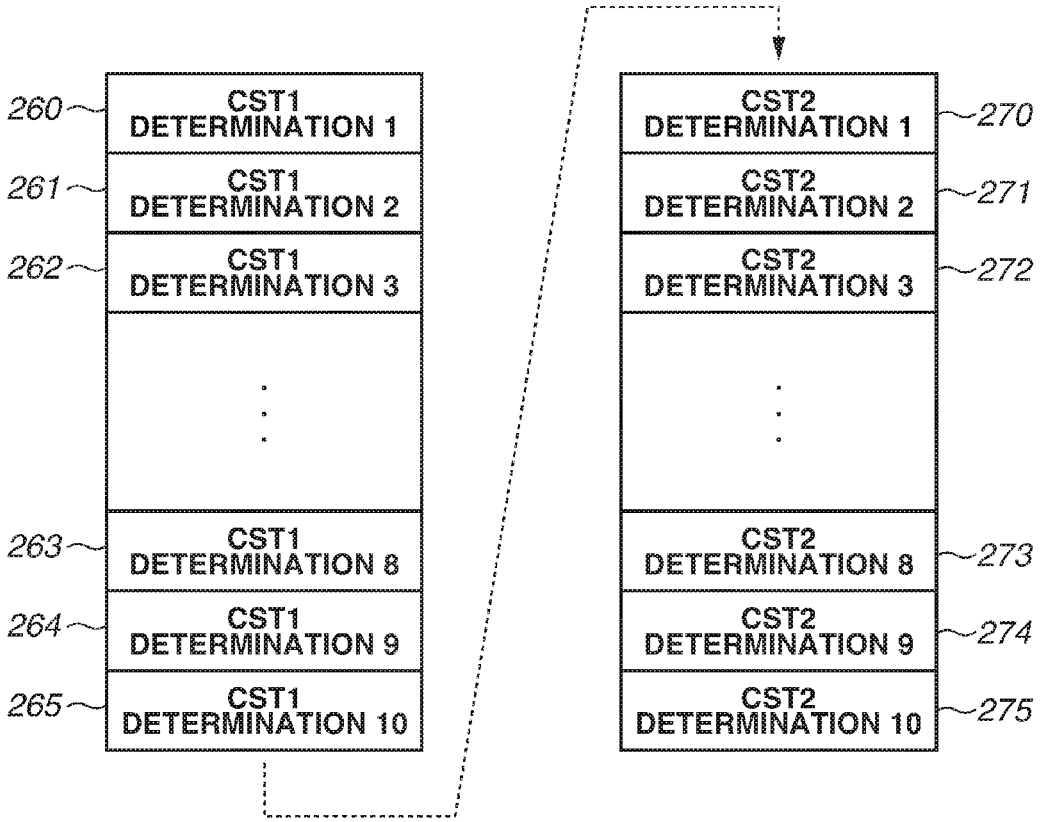
FIG. 6 is a diagram illustrating a state where sheet characteristic data is stored in a read only memory (RAM).

The CPU 10 can determine the material properties (thickness) of the sheet S as the sheet characteristic (sheet characteristic data), by acquiring information about the amount of reflection light from the medium sensor 14. The CPU 10 stores the determined sheet characteristic data into the RAM 12. FIG. 6 is a diagram illustrating a state where the sheet characteristic data is stored in the RAM 12. The sheet characteristic data is stored in a predetermined storage area of the RAM 12. The storage area(s), in which the sheet characteristic data is stored is (are) formed in the RAM 12 according to the number of the sheet feed cassettes. The storage area(s) is (are) provided in correspondence with a predetermined number of the sheets S. The sheet characteristic data corresponding to a single sheet is stored individually in a different storage area.

Characteristic data about the sheets S fed from the first sheet feed cassette 220 is stored at addresses 260 to 265 of the RAM 12. The addresses 260 to 265 each store the individual data for one sheet of the sheets S. The CPU 10 sequentially writes data representing the determined sheet characteristic(s) one sheet by one sheet, at addresses starting from the address 260. The RAM 12 sequentially stores the characteristic data for ten sheets fed from the first sheet feed cassette 220. The characteristic data of a first sheet is overwritten with the characteristic data of an eleventh sheet, at the address 260. In other words, the RAM 12 stores the characteristic data for the latest ten sheets. In a case where the first sheet feed cassette 220 is removed from the image forming apparatus 100, the sheet characteristic data stored at the addresses 260 to 265 is cleared. In other words, the CPU 10 clears data at the addresses 260 to 265 of the RAM 12, in a case where the first sheet feed cassette open/close sensor 18 detects that the first sheet feed cassette 220 is drawn out from the image forming apparatus 100.

Characteristic data of the sheets S fed from the second sheet feed cassette 221 is stored at addresses 270 to 275 of the RAM 12. The CPU 10 sequentially writes data representing the detected sheet characteristic(s), at addresses starting from the address 270. In a case where the second sheet feed cassette 221 is removed from the image forming apparatus 100, the sheet characteristic data stored at the addresses 270 to 275 is deleted. In other words, the CPU 10 clears data at the addresses 270 to 275 of the RAM 12, in a case where the second sheet feed cassette open/close sensor 19 detects that the second sheet feed cassette 221 is drawn out from the image forming apparatus 100.

(Timing Chart)

Figure 7A:
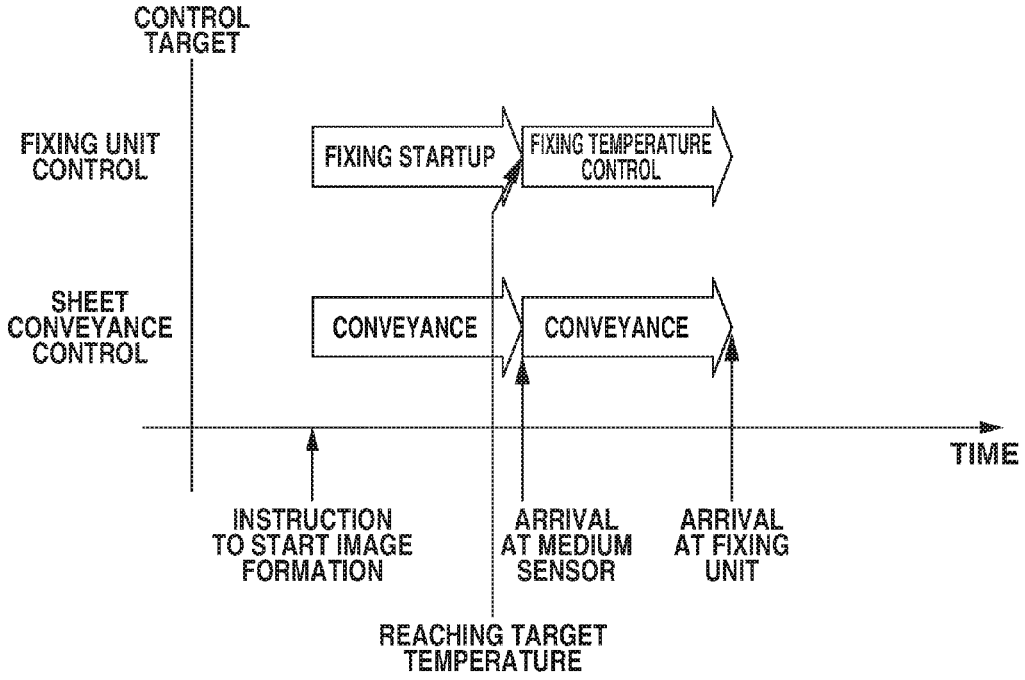
FIGS. 7A and 7B are timing charts each illustrating conveyance timing and temperature control timing.
Figure 7B:
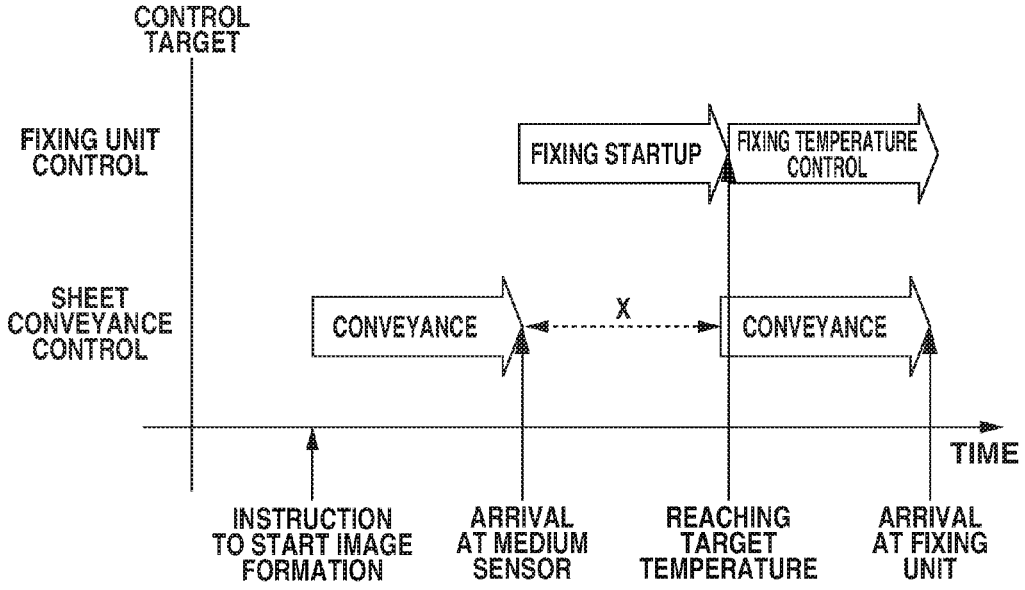

As described above, the operation mode of the image forming apparatus 100 includes the "automatic detection mode" and the "user specification mode". FIGS. 7A and 7B are timing charts each illustrating conveyance timing for the sheet S and timing for temperature control of the fixing unit 170. FIGS. 7A and 7B correspond to the user specification mode and the automatic detection mode, respectively.

FIG. 7A is the timing chart in operation in the user specification mode. In response to receiving an instruction to start the image forming process, the CPU 10 causes the image formation unit 20 to initiate startup (heating) of the fixing unit 170. When the temperature of the fixing unit 170 reaches a target temperature, the CPU starts image formation, and performs a temperature adjustment to maintain the temperature of the fixing unit 170 at the target temperature. In the user specification mode, since the sheet characteristic (s) is (are) input by the user, the CPU 10 starts the temperature adjustment to reach an optimum fixing temperature (the target temperature) according to the sheet characteristics.

The CPU 10 performs control in such a manner that a timing of initiating the startup of the fixing unit 170 and a timing of starting the conveyance of the sheet S by the image formation unit 20 matches with each other. When the temperature of the fixing unit 170 reaches the target temperature, the CPU 10 waits for arrival of the sheet S, while performing monitoring to prevent deviation of the fixing temperature from the target temperature. After the sheet characteristics of the sheet S are detected by the medium sensor 14 and the temperature of the fixing unit 170 is detected to reach the target temperature, the toner image is transferred to the sheet S at the secondary transfer unit 140. The sheet S is then conveyed to the fixing unit 170. Since the temperature of the fixing unit 170 has already reached the target temperature, the toner image is fixed to the sheet S.

In this way, the startup of the fixing unit 170 can be performed immediately after the instruction to start the image formation is issued because the sheet characteristic(s) is (are) input by the user in the user specification mode.

FIG. 7B is the timing chart in operation in the automatic detection mode. In the automatic detection mode, since the sheet characteristic(s) is (are) not input by the user, the CPU 10 needs to determine the target temperature of the fixing unit 170 after the sheet characteristic(s) of the sheet S is (are) detected by the medium sensor 14. In response to receiving an instruction to start the image forming process, the CPU 10 causes the image formation unit to start the image formation. However, the CPU 10 delays the start of the temperature adjustment of the fixing unit 170 until the sheet characteristic(s) of the sheet S is (are) determined based on the output of the medium sensor 14.

When the sheet S is conveyed to the medium sensor 14, the medium sensor 14 starts detection of the characteristics of the sheet S. The medium sensor 14 transmits the detection result about the characteristics of the sheet S to the CPU 10. The CPU 10 determines the sheet characteristic(s) based on the detection result obtained from the medium sensor 14, and determines the target temperature of the fixing unit 170. The CPU 10 can thereby start the temperature adjustment of the fixing unit 170.

The CPU 10 causes the image formation unit 20 to temporarily stops the conveyance of the sheet S at the position of the registration roller 161 until the temperature of the fixing unit 170 reaches the target temperature. In response to the temperature of the fixing unit 170 having reached the target temperature, the CPU 10 causes the image formation unit 20 to restart the conveyance of the sheet S, and perform the image formation on the sheet S. As described above, a typical automatic detection mode does not allow the temperature adjustment of the fixing unit 170 to start until the sheet characteristic(s) is (are) detected by the medium sensor 14, so that time period for the image formation increases by time period X during which the conveyance of the sheet S is stopped. For this reason, an effective image forming process cannot be performed.

In view of the above, the target temperature of the fixing unit 170 is determined according to the sheet characteristic (s) previously detected by the medium sensor 14, according to the present exemplary embodiment. Accordingly, the operation of the image forming apparatus 100 can be controlled in such a manner that the time period for the image formation in the automatic detection mode becomes about the same as that in the user specification mode. To that end, the CPU 10 operates in the user specification mode, as follows. In response to receiving an instruction to start the image formation, the CPU 10 causes the image formation unit 20 to start the image formation, and simultaneously initiates the startup of the fixing unit 170. At the same time, the CPU 10 causes the medium sensor 14 to detect the characteristic of the sheet S. Here, the target temperature of the fixing unit 170 corresponds to the sheet characteristic(s) specified by the user. Accordingly, in a case where the automatic detection mode is selected, the image formation is performed in about the same time period as that in the user specification mode from the beginning of the image formation for the first sheet S.

(Fixing Temperature Control)

Figure 8:
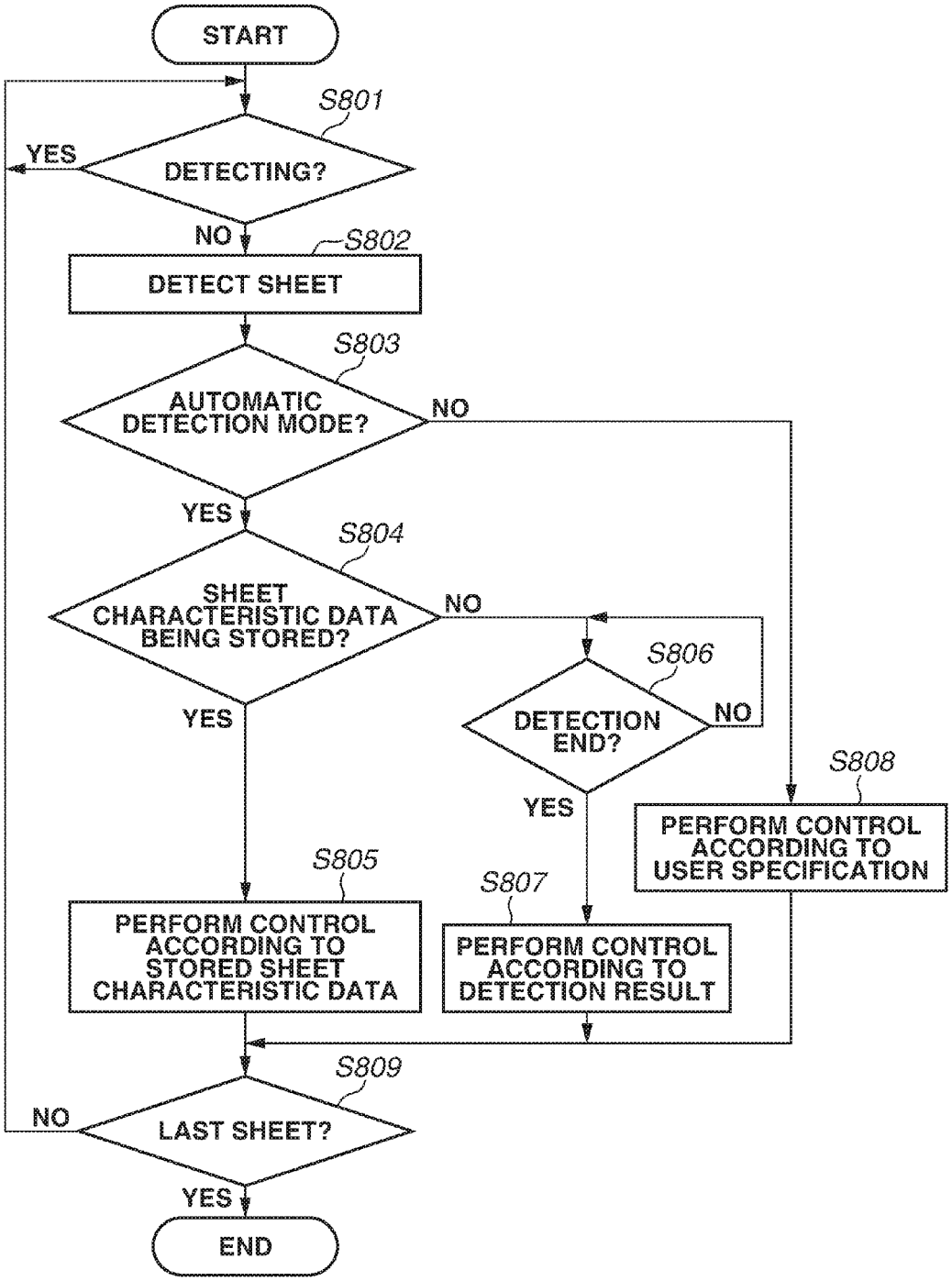
FIG. 8 is a flowchart illustrating temperature control processing.

FIG. 8 is a flowchart illustrating temperature control processing of the fixing unit 170. This temperature control processing is executed in a case where the CPU 10 receives the instruction to start the image forming process.

In step S801, the CPU 10 checks whether the medium sensor 14 is detecting the characteristics of the sheet S. This temperature control processing is repeated until the image formation on the sheet S is completed for all the specified number of sheets. Thus, whether or not detecting of the characteristics of the sheet S through the previous temperature control processing is completed needs to be checked in the process of step S801. If the medium sensor 14 is detecting the characteristics of the sheet S (YES in step S801), the CPU 10 waits until the detection is completed.

If the medium sensor 14 is not detecting the characteristics of the sheet S (NO in step S801), the CPU 10 causes the image formation unit 20 to feed and convey the sheet S, and the processing proceeds to step S802. In step S802, the medium sensor 14 performs processing for detecting the characteristics of the sheet S, when the sheet S arrives at the medium sensor 14. The detection processing of the sheet S in step S802 is performed regardless of whether the user specification mode or the automatic detection mode is specified. This will be described in detail below.

In step S803, the CPU 10 checks whether the automatic detection mode is set as the operation mode. If the automatic detection mode is set (YES in step S803), the processing proceeds to step S804. In step S804, the CPU 10 checks whether the characteristic data of the sheet which is contained in the cassette and specified as the image forming condition is stored in the RAM 12. If the sheet characteristic (s) of the sheet S contained in the first sheet feed cassette 220 and the sheet characteristic(s) of the sheet S contained in the second sheet feed cassette 221 have been previously detected, data representing sheet characteristics of these sheets is stored in the RAM 12.

If the sheet characteristic data is stored in the RAM 12 (YES in step S804), the processing proceeds to step S805. In step S805, based on the stored sheet characteristic data, the CPU 10 determines the target temperature of the fixing unit 170, and controls the fixing unit 170 in such a manner that the fixing temperature reaches the target temperature. If the sheet characteristic data is not stored in the RAM 12 (NO in step S804), the processing proceeds to step S806. In step S806, the CPU 10 determines whether a detection result is obtained from the medium sensor 14. If the detection result is obtained from the medium sensor 14 (YES in step S806), the processing proceeds to step S807. In step S807, the CPU 10 determines the target temperature according to the detection result and controls the fixing unit 170 in such a manner that the fixing temperature reaches the target temperature.

If the operation mode is the user specification mode (NO in step S803), the processing proceeds to step S808. In step S808, the CPU 10 determines the target temperature according to the sheet characteristic(s) input by the user without referring to the sheet characteristics detected in step S802, and controls the fixing unit 170 in such a manner that the fixing temperature reaches the target temperature. The fixing temperature of the fixing unit 170 is controlled so as to reach the target temperature through any of processes in step S805, step S807, and step S808. The fixing unit 170 can thus perform a process for fixing the toner image to the sheet S on which the toner image is transferred.

After the temperature control of the fixing unit 170 ends, the processing proceeds to step S809. In step S809, the CPU 10 determines whether the image forming process is completed for all the specified number of sheets S. If the image forming process is not completed for all the sheets S (NO in step S809), the processing starting from step S801 is repeated. If the image forming process is completed for all the sheets S (Yes in step S809), the processing ends.

Figure 9:
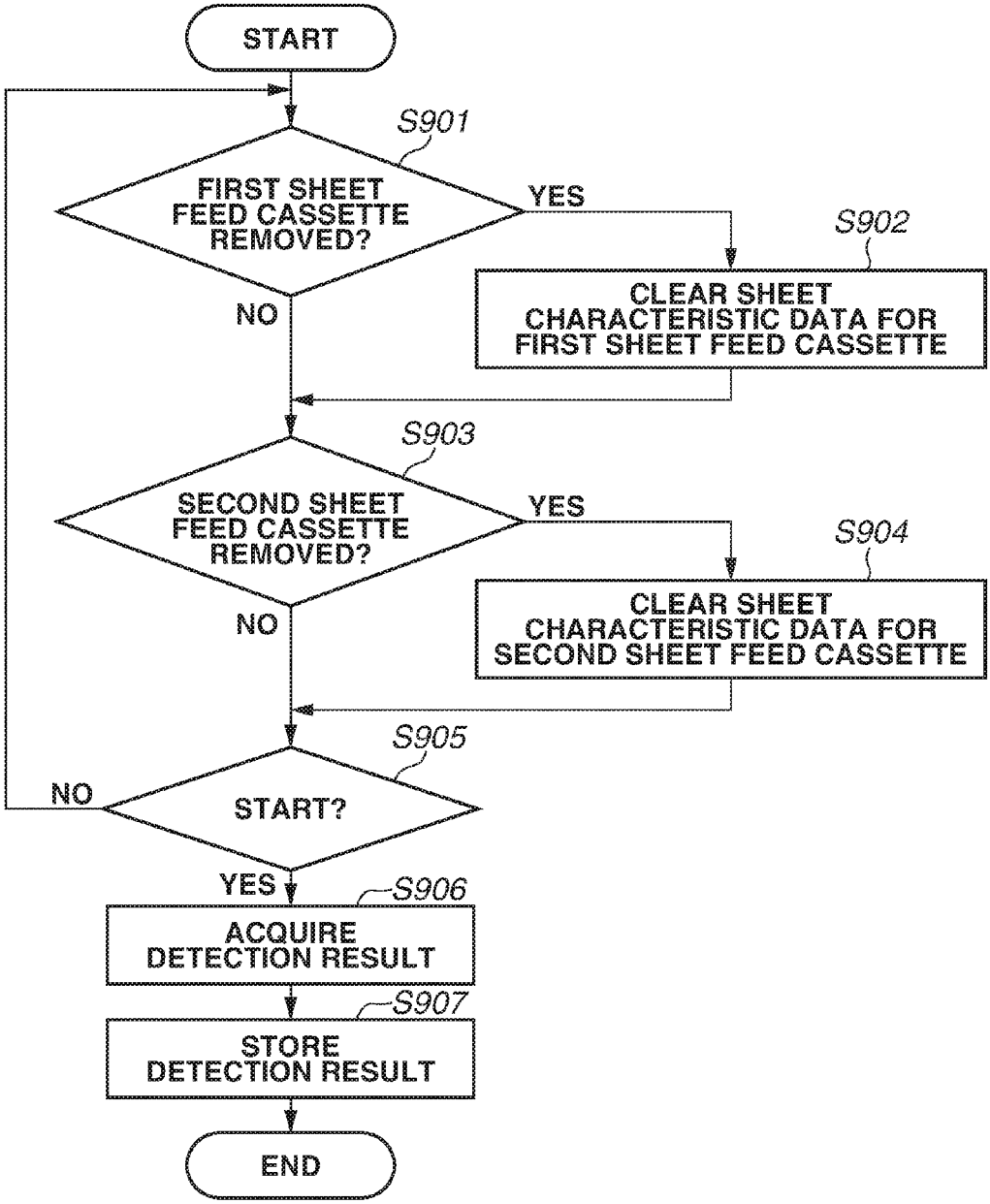
FIG. 9 is a flowchart illustrating sheet detection processing.

FIG. 9 is a flowchart illustrating the processing for detecting the sheet S in step S802. This flowchart includes processes before the processing for detecting the sheet S is performed.

In step S901, in response to power-on of the image forming apparatus 100, the CPU 10 determines whether the first sheet feed cassette 220 is drawn out from the image forming apparatus 100. The CPU 10 performs this determination based on whether the first sheet feed cassette 220 is detected by the first sheet feed cassette open/close sensor 18. If the first sheet feed cassette 220 is drawn out from the image forming apparatus 100 (YES in step S901), the processing proceeds to step S902. In step S902, the CPU 10 clears information about the sheet characteristic(s) for the first sheet feed cassette 220 stored in the RAM 12.

In step S903, the CPU 10 determines whether the second sheet feed cassette 221 is drawn out from the image forming apparatus 100. The CPU 10 performs this determination based on whether the second sheet feed cassette 221 is detected by the second sheet feed cassette open/close sensor 19. If the second sheet feed cassette 221 is drawn out from the image forming apparatus 100 (YES in step S903), the processing proceeds to step S904. In step S904, the CPU 10 clears information about the sheet characteristic data for the second sheet feed cassette 221 stored in the RAM 12.

The CPU 10 repeatedly monitors such open and close of the first sheet feed cassette 220 and the second sheet feed cassette 221, and the drawing of the first sheet feed cassette 220 and/or the second sheet feed cassette 221 causes the CPU 10 to delete information about corresponding sheet characteristic data from the RAM 12. If the processing for detecting the sheet S is instructed in step S802 in FIG. 8, the CPU 10 starts the processing for detecting the sheet S (YES in step S905). Next, in step S906, the CPU 10 obtains a detection result of the sheet S from the medium sensor 14, and in step S907, the CPU 10 stores the sheet characteristic data corresponding to the obtained detection result into the RAM 12. When storing the sheet characteristic data into the RAM 12 is completed, the processing for detecting the sheet S ends, and processing in step S803 in FIG. 8 is performed. The CPU 10 repeats step S901 to step S905 even after the processing for detecting the sheet S ends.

(Operation Form)

Figure 10:
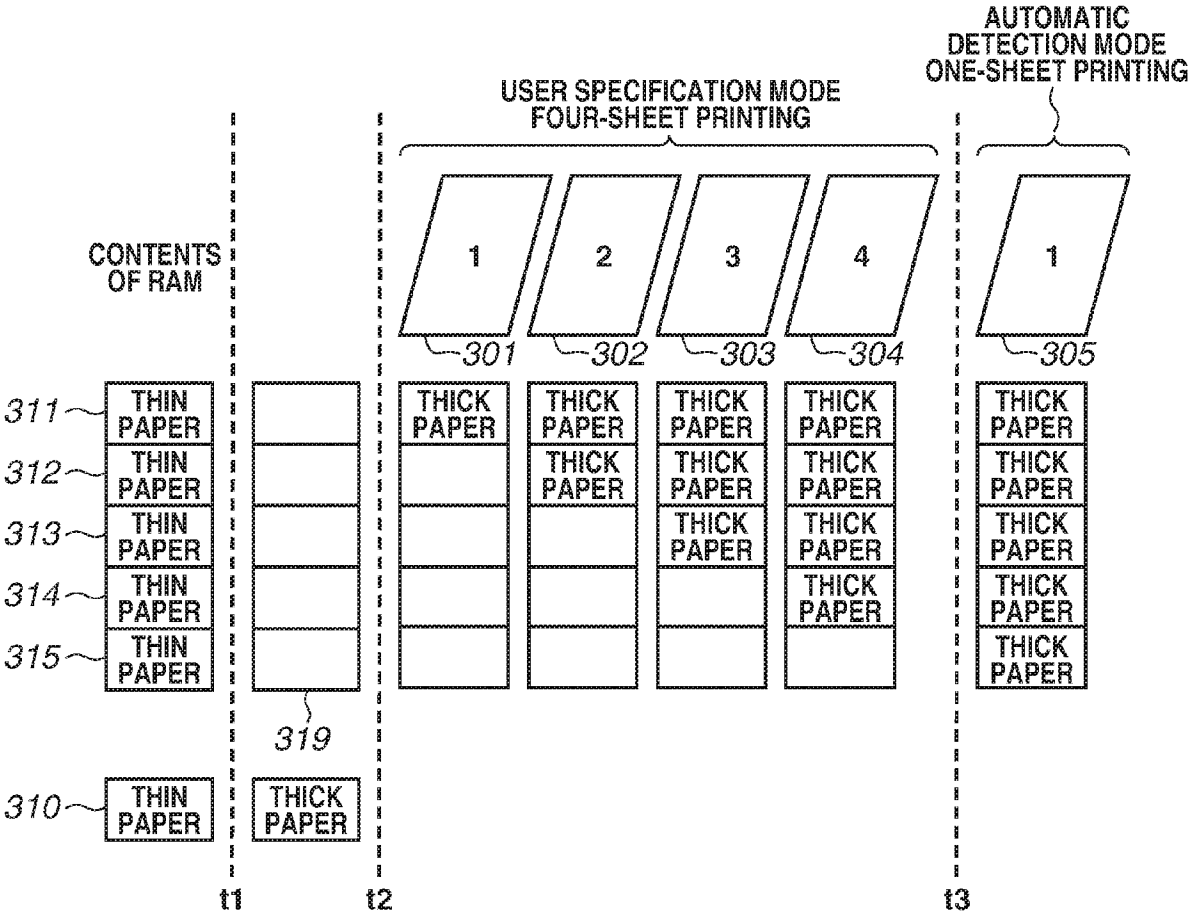
FIG. 10 is a diagram illustrating specific operation for a print job.

FIG. 10 is a diagram illustrating specific operation of the image forming apparatus 100 for a print job. Storage areas 311 to 315 in the RAM 12 in FIG. 10 correspond to the storage areas described in FIG. 6. Data about the sheet characteristic(s) specified in the user specification mode is stored in a storage area 310 different from the storage areas 311 to 315. In FIG. 10, how the contents of the storage areas 310 to 315 change is illustrated in a lateral direction. Assume that the sheets S of the thin paper are contained in the first sheet feed cassette 220, and the thin paper is set as the sheet characteristic(s) in the user specification mode. Here, a description is given taking as an example a case where the image forming process is performed in the user specification mode for four sheets S contained in the first sheet feed cassette 220. The operation mode is then changed to the automatic detection mode, and the image forming process is performed in the automatic detection mode for one sheet S fed from the first sheet feed cassette 220.

In FIG. 10, the first sheet feed cassette 220 is attached to the image forming apparatus 100 before time t1, the storage areas 311 to 315 store the sheet characteristic data representing that five sheets S fed from the first sheet feed cassette 220 each is a thin paper. This sheet characteristic data is the sheet characteristic data detected in the image forming operation performed immediately before. The sheet characteristic representing the thin paper specified in the user specification mode is stored in the storage area 310. In a case where the first sheet feed cassette 220 is drawn out from the image forming apparatus 100 at the time t1, the sheet characteristic data stored in the storage areas 311 to 315 is cleared, and these areas of the RAM 12 each become a blank 319. The data in the storage area 310 remains unchanged even if the sheet feed cassette is drawn out, unless the user changes the sheet characteristic(s).

In a case where the first sheet feed cassette 220 is attached to the image forming apparatus 100, and the thick paper is specified as the sheet characteristic in the user specification mode, the image forming apparatus 100 sequentially feed the four sheets S from the first sheet feed cassette 220 if an instruction to start the image forming process is issued at time t2.

A sheet 301 fed first is specified as the thick paper by the user. Accordingly, the CPU 10 sets the fixing temperature corresponding to the thick paper as the target temperature of the fixing unit 170 through the process in step S808 in FIG. 8. In addition, the CPU 10 stores the sheet characteristic data corresponding to the detection result of the medium sensor 14 into the RAM 12 in step S907 of FIG. 9. Here, the thick paper is fed from the first sheet feed cassette 220, so that the medium sensor 14 detects that the sheet characteristic of the sheet S is the thick paper for the first sheet. Then information about the sheet characteristics representing the sheet S being the thick paper is stored into the storage area 311, which corresponds to a storage area for the first sheet in the RAM 12.

A second sheet 302 is similarly processed, and the sheet characteristic data representing the thick paper is stored into the storage area 312 allocated for the second sheet. A third sheet 303 is similarly processed, and the sheet characteristic data representing the thick paper is stored into the storage area 313 allocated for the third sheet. A fourth sheet 304 is similarly processed, and the sheet characteristic data representing the thick paper is stored into the storage area 314 allocated for the fourth sheet. Here, the image forming process is completed once. The storage area 315 allocated for a fifth sheet thus remains blank.

At time t3, the automatic detection mode is specified in a new image forming process, and an instruction to start the image forming process is issued. The image forming apparatus 100 feeds the fifth sheet S from the first sheet feed cassette 220 in the automatic detection mode.

Here, the CPU 10 operates in the automatic detection mode, and the sheet characteristic indicating the thick paper is stored in the storage areas 311 to 314 of the RAM 12. Accordingly, the CPU 10 controls the fixing temperature of the fixing unit 170 so as to reach the temperature corresponding to the sheet characteristic (thick paper) through process in step S805 in FIG. 8. The image forming apparatus 100 performs the image formation on a sheet 305 at this temperature. The CPU 10 stores the sheet characteristic data corresponding to the detection result of the medium sensor 14 into the storage area 315 of the RAM 12 in step S907 in FIG. 9, also in the automatic detection mode.

In the present exemplary embodiment, a description has been given taking as an example a case where the image forming apparatus 100 adjusts the target temperature of the fixing unit 170 or the conveyance speed of the sheet S conveyed in the fixing unit 170 according to the sheet characteristic(s). The image forming apparatus 100 may control the operations of the laser scanners 122*a* to 122*d* and the image forming units 120*a* to 120*d*, according to the sheet characteristic(s). For example, the CPU 10 may perform an adjustment for quality of an image to be formed on the sheet S, according to the sheet characteristic(s), by using the image formation unit 20. Examples of the adjustment include an adjustment of the amount of a laser beam emitted from the laser scanners 122*a* to 122*d*, and an adjustment of a toner density in the developing unit. At least one of the adjustment of the fixing unit 170 and the adjustment of the laser scanners 122*a* to 122*d* and the image forming units 120*a* to 120*d* may be performed.

As described above, the image forming apparatus 100 of the present exemplary embodiment detects the sheet characteristic(s) with the medium sensor 14, and stores the detection result into the RAM 12 even in a case where the operation mode is the user specification mode. As a result, the medium sensor 14 detects all the sheets S, but the time period for the detection by the medium sensor 14 is shorter than the time period for the adjustment of the temperature of the fixing unit 170. Accordingly, the detection by the medium sensor 14 has a small influence on the time period for the image forming process. As a result, even in a case where the operation mode is changed from the user specification mode to the automatic detection mode, the image forming apparatus 100 can perform the image formation process for a shorter time than that in the conventional automatic detection mode.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-018279, filed Feb. 2, 2016, which is hereby incorporated by reference herein in its entirety.

What is claimed is:

1. An image forming apparatus comprising:

a sheet container configured to contain a sheet;

an image forming unit configured to form an image on the sheet fed from the sheet container;

a sensor configured to detect a characteristic of the sheet fed from the sheet container;

a memory configured to store characteristic data representing the characteristic detected by the sensor;

a selector configured to select either a first mode or a second mode; and a controller i) configured to determine, in a case where the first mode is selected by the selector, an image forming condition according to the characteristic data, which is input by a user and represents a characteristic of a sheet contained in the sheet container and cause the sensor to detect a characteristic of a sheet, and store characteristic data according to a result of the detection into the memory, and ii) configured to determine, in a case where the second mode is selected by the selector with the characteristic data being stored in the memory, an image forming condition based on the characteristic data stored in the memory before a result of detecting a characteristic of a sheet by the sensor is obtained, and configured to cause, in a case where the second mode is selected by the selector with the characteristic data not being stored in the memory, the sensor to detect a characteristic of a sheet, and determine an image forming condition based on a result of the detection by the sensor.

2. The image forming apparatus according to claim 1, further comprising a container sensor configured to detect whether the sheet container is drawn out from the image forming apparatus, wherein, in a case where the container sensor detects the sheet container being drawn out, the controller deletes the characteristic data stored in the memory.

3. The image forming apparatus according to claim 2, wherein the image forming apparatus has a plurality of the sheet containers, wherein the memory has storage areas each corresponding to a different one of the plurality of sheet containers, and wherein the controller deletes the characteristic data in a storage area corresponding to the sheet container being drawn out.

4. The image forming apparatus according to claim 1, wherein the memory has storage areas each of which stores characteristic data corresponding to a different one of a predetermined number of sheets fed from the sheet container.

5. The image forming apparatus according to claim 4, wherein, after the characteristic data is stored in all the storage areas each corresponding to a different one of the predetermined number of sheets, the memory stores characteristic data about a different sheet into a storage area which has stored characteristic data at the earliest.

6. The image forming apparatus according to claim 1, wherein the sensor detects a characteristic about a thickness of a sheet.

7. The image forming apparatus according to claim 1, wherein the image forming unit has a fixing unit for fixing, by heat, a toner image transferred onto a sheet, and wherein, based on the characteristic data, the controller determines a target temperature of the fixing unit.

8. The image forming apparatus according to claim 7, wherein, based on the characteristic data, the controller determines a speed at which the fixing unit conveys a sheet.

9. A method for determining an image forming condition in an image forming apparatus, the image forming apparatus including a sheet container configured to contain a sheet;

an image forming unit configured to form an image on the sheet fed from the sheet container, a sensor configured to detect a characteristic of the sheet fed from the sheet container, a memory configured to store characteristic data representing the characteristic detected by the sensor, and a selector configured to select either a first mode or a second mode, the method comprising:

determining, in a case where the first mode is selected by the selector, an image forming condition according to the characteristic data, which is input by a user and represents a characteristic of a sheet contained in the sheet container, and causing the sensor to detect a characteristic of a sheet, and storing characteristic data according to a result of the detection into the memory;

determining, in a case where the second mode is selected by the selector with the characteristic data being stored in the memory, an image forming condition based on the characteristic data stored in the memory before a result of detecting a characteristic of a sheet by the sensor is obtained; and causing, in a case where the second mode is selected by the selector with the characteristic data not being stored in the memory, the sensor to detect a characteristic of a sheet, and determining an image forming condition based on a result of the detection by the sensor.

* * * * *